US011110700B2

(12) United States Patent
Kuendgen et al.

(10) Patent No.: US 11,110,700 B2
(45) Date of Patent: Sep. 7, 2021

(54) METHOD FOR CHANGING PLATES ON A CYLINDER

(71) Applicant: HEIDELBERGER DRUCKMASCHINEN AG, Heidelberg (DE)

(72) Inventors: Rolf Kuendgen, Bad Schoenborn (DE); Rudi Stellberger, Kronau (DE); Dirk Schoenmann, Limburgerhof (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 307 days.

(21) Appl. No.: 16/262,992

(22) Filed: Jan. 31, 2019

(65) Prior Publication Data

US 2019/0255835 A1 Aug. 22, 2019

(30) Foreign Application Priority Data

Feb. 22, 2018 (EP) ..... 18157995

(51) Int. Cl.
*B41F 27/12* (2006.01)
*B41F 27/06* (2006.01)

(52) U.S. Cl.
CPC ..... *B41F 27/1206* (2013.01); *B41F 27/06* (2013.01); *B41F 27/1212* (2013.01); *B41F 27/1218* (2013.01); *B41F 27/1231* (2013.01); *B41P 2227/62* (2013.01); *B41P 2227/63* (2013.01)

(58) Field of Classification Search
CPC .. B41F 27/12; B41F 27/1206; B41F 27/1212; B41P 2227/12; B41P 2227/60; B41P 2227/62; B41P 2227/63
USPC ..... 101/477
See application file for complete search history.

(56) References Cited

U.S. PATENT DOCUMENTS 5,259,314 A 11/1993 Sugiyama
5,642,669 A 7/1997 Becker
6,053,105 A * 4/2000 Rudzewitz ..... B41F 27/1206 101/477

(Continued)

FOREIGN PATENT DOCUMENTS

CN 1134882 A 11/1996
CN 103608181 A 2/2014

(Continued)

*Primary Examiner* — Leslie J Evanisko
(74) *Attorney, Agent, or Firm* — Laurence A. Greenberg; Werner H. Stemer; Ralph E. Locher

(57) ABSTRACT

A method and device change printing plates on a cylinder. The method includes opening a first clamping device and releasing a leading edge of a first printing plate and opening a second clamping device and releasing a trailing edge of the first printing plate. The first and second clamping devices are both opened before a first rotation process of a cylinder. The cylinder is rotated during the first rotation process in a first direction to dismount the first printing plate from a circumferential surface of the cylinder. The cylinder is rotated in a second rotation process in an opposite second direction to mount a second printing plate replacing the first printing plate to the circumferential surface of the cylinder. Because the first clamping device and the second clamping device are both opened before the first rotation of the cylinder, the set-up period required for a printing plate change is reduced.

3 Claims, 5 Drawing Sheets

(56) References Cited

U.S. PATENT DOCUMENTS

| | | | |
|---|---|---|---|
| 8,857,335 | B2 | 10/2014 | Boehm et al. |
| 8,869,697 | B2 | 10/2014 | Kress et al. |

FOREIGN PATENT DOCUMENTS

| | | | |
|---|---|---|---|
| CN | 107175906 | A | 9/2017 |
| DE | 102012014806 | A1 | 2/2013 |
| WO | 2004028809 | A1 | 4/2004 |

* cited by examiner

METHOD FOR CHANGING PLATES ON A CYLINDER

CROSS-REFERENCE TO RELATED APPLICATION

This application claims the priority, under 35 U.S.C. § 119, of European Patent Application EP 18 157 995.4, filed Feb. 22, 2018; the prior application is herewith incorporated by reference in its entirety.

BACKGROUND OF THE INVENTION

Field of the Invention

The technical field of the invention is in the field of the graphic industry, in particular in the field of what is known as lithographic offset printing, i.e. indirect planographic printing onto flat substrates where printing inks and/or varnish are applied to sheet or web-shaped printing material, which is preferably made of paper, paperboard, cardboard, or plastic. In particular, the invention refers to the technical field of changing printing plates.

In lithographic offset printing, an automated job change includes a plate changing operation: a printing plate that has been printed is dismounted from a forme cylinder and a new printing plate for the next print job is mounted to the forme cylinder. In this process, clamping devices that hold the leading and trailing edges of the printing plate to fix the printing plates on the circumferential surface of the cylinder are opened and closed and the forme cylinder is rotated in forward and backward directions. A printing plate change may be assisted in by an automated plate changer, which supplies the new printing plate and receives the old one.

A problem that may occur in prior art plate changing operations is that a printing plate change takes up much set-up time and does not sufficiently meet the ever increasing demands to shorten set-up periods in order to save time and ultimately costs.

Published, non-prosecuted German patent application DE 10 2012 014 806 A1, corresponding to U.S. Pat. No. 8,857,335, discloses a method and a device for changing printing plates. A clamping device clamping a trailing edge of a printing plate is opened while the plate cylinder rotates in a backward direction and a clamping device clamping the leading edge of the printing plate is opened before the printing plate is gripped by transport rollers.

SUMMARY OF THE INVENTION

It is accordingly an object of the invention to provide a method and a device for changing plates on a cylinder that overcome the above-mentioned disadvantages of the prior art devices and methods of this general type which provide an improvement over the prior art especially in terms of reducing the set-up times that are required to change printing plates.

The solution in the form of a method of the invention is now described.

In accordance with the invention, the object is attained by a method described in the main method claim and by a device described in the main device claim. Advantageous and thus preferred further developments of the invention will become apparent from the dependent claims as well as from the description and drawings.

In accordance with the invention, a method for changing printing plates on a cylinder contains the steps of rotating, namely of a first rotation of the cylinder in a first direction to dismount a first printing plate from the circumferential surface of the cylinder, a second rotation of the cylinder in an opposite second direction to mount a second printing plate replacing the first printing plate to the circumferential surface of the cylinder, and the steps of opening, namely of opening a first clamping device and releasing a leading edge of the first printing plate, opening a second clamping device and releasing a trailing edge of the first printing plate. The method is characterized in that the first clamping device and the second clamping device are both opened before the first rotation of the cylinder.

Due to the invention, the set-up period required for a printing plate change may advantageously be reduced: the two clamping devices are opened and remain open until they are to clamp another printing plate edge. Eliminating any intermediate closing of the clamping devices (when no printing plate is to be clamped) advantageously saves time.

Further developments of the method of the invention are now discussed.

A preferred further development of the invention may be characterized in that the first clamping device and the second clamping device both remain open during the first rotation.

A preferred further development of the invention may be characterized in that the first clamping device and the second clamping device both remain open during a period between the first rotation and the second rotation.

A preferred further development of the invention may be characterized in that the first clamping device and the second clamping device both remain open during an intermediate rotation in the second direction occurring between the first rotation and the second rotation.

A preferred further development of the invention may be characterized in that the first clamping device is closed before the second rotation.

A preferred further development of the invention may be characterized in that the second clamping device is closed after the second rotation.

A preferred further development of the invention may be characterized in that the respective opening and closing of the two clamping devices is achieved using two releasable check valves and two associated pneumatic control lines for releasing the check valves. The check valves and the control lines may preferably be disposed inside the cylinder. The required compressed air my preferably be provided by a rotary joint of the cylinder.

The solution in a form of a device of the invention is now discussed.

In accordance with the invention, a device for implementing one of the aforementioned methods contains a cylinder, a releasable first check valve in a first pneumatic line leading to the first clamping device and a releasable second check valve in a second pneumatic line leading to the second clamping device.

Due to the invention, the set-up period required for a printing plate change may advantageously be reduced. In addition, this solution is very cost-efficient.

Further developments of the device of the invention are now discussed.

A preferred further development of the invention may be characterized in that the first check valve is connected to the second pneumatic line by a first control line provided for releasing purposes.

A preferred further development of the invention may be characterized in that the second check valve is connected to a third pneumatic line by a second control line provided for releasing purposes.

The two control lines are preferably disposed inside the cylinder.

The respective releasing is achieved via a respective one of the two control lines. This measure advantageously makes additional electric control lines unnecessary.

A preferred further development of the invention may be characterized in that the first and second check valves are disposed inside the cylinder.

An advantageous aspect of arranging the two control lines and the two check valves inside the cylinder is that additional pneumatic lines through a rotary joint of the cylinder become unnecessary.

The features of the invention, of the further developments of the invention, and of the exemplary embodiments of the invention may be combined with one another to create advantageous further developments of the invention. In addition, further developments of the invention may include the individual features or combinations of features disclosed in the above sections entitled "Field of the Invention".

The invention and the preferred further developments thereof will be explained in more detail below with reference to the drawings and based on a preferred exemplary embodiment. In the figures, mutually corresponding elements have the same reference symbols.

Other features which are considered as characteristic for the invention are set forth in the appended claims.

Although the invention is illustrated and described herein as embodied in a method and a device for changing plates on a cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Referring now to the figures of the drawings in detail and first, particularly to FIGS. 1-7 thereof, there is shown schematic side views of a preferred embodiment of a device of the invention during a step-by-step implementation of a preferred embodiment of the method of the invention.

Figure 1:
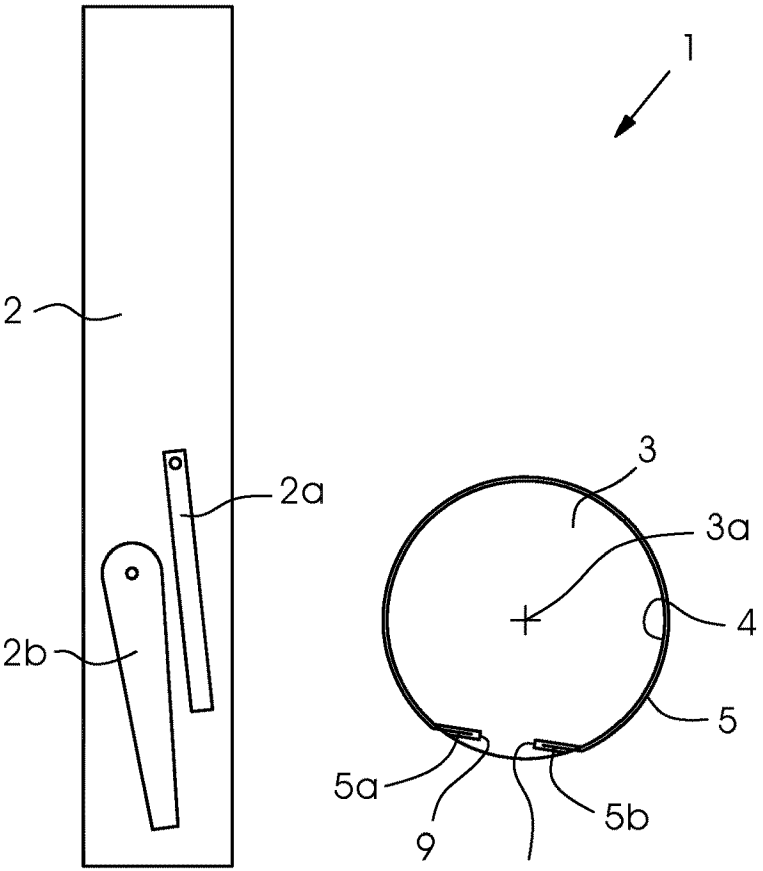

FIG. 1 illustrates a printing press 1, in particular a sheet-processing lithographic offset printing press, containing an automated plate changing device 2 and a cylinder 3, in particular a printing plate cylinder or forme cylinder. The plate changing device includes a first pivoting guide 2*a* and a second pivoting guide 2*b* for printing plates to be changed and non-illustrated rollers. The cylinder and the plate changing device are supported on/fixed to non-illustrated side walls of the printing machine. A control unit that is provided to implement the automated printing plate change is likewise not illustrated. The control unit controls the rotary movements of the cylinders, the pivoting movements of the guides, and the translatory movements of the printing plates to be changed via drives, which are likewise not illustrated.

The cylinder has an axis 3*a* and a circumferential surface 4. A first printing plate 5 is received/mounted to the surface 4. A leading edge 5*a* of the first printing plate 5 is held in a first clamping device 9 and a trailing edge 5*b* of the first printing plate is held in a second clamping device 10. The first clamping device is preferably embodied as a known clamping bar for the leading edge 5*a*. The second clamping device is preferably embodied as a known tensioning bar for a trailing edge 5*a*.

FIG. 1 shows the cylinder 3 in a first stand-by position after a first print job has been completed. The first printing plate 5 has thus been used in a printing operation.

Figure 2:
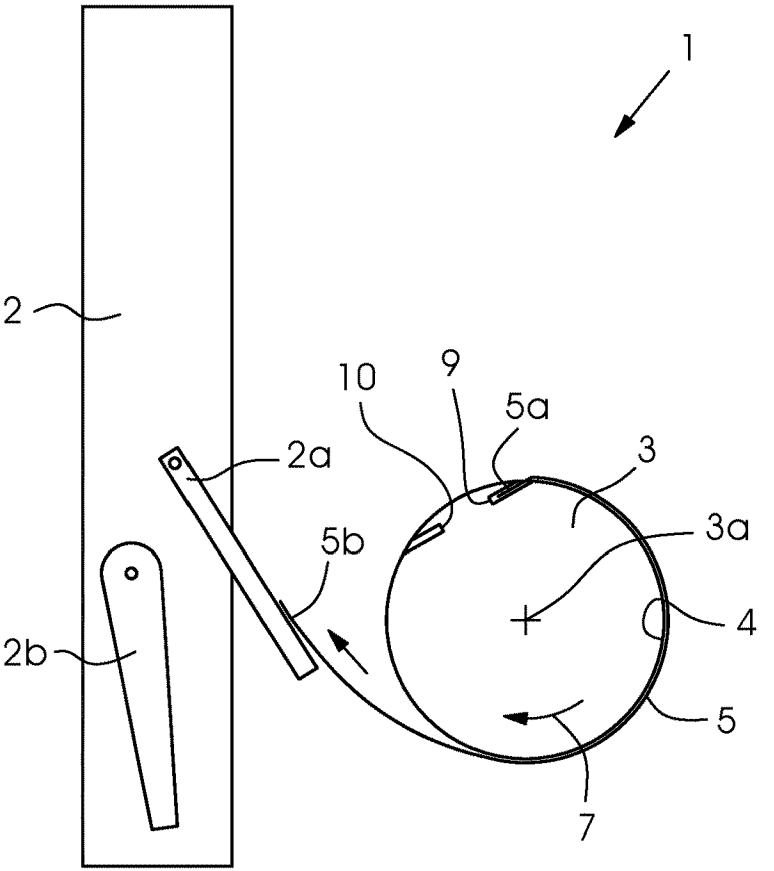
FIGS. 1 to 7 are diagrammatic, side views of a preferred embodiment of a device according to the invention.

FIG. 2 illustrates the same cylinder 3 during a rotation (first rotation) in a first direction 7. FIG. 2 shows that the second clamping device 10 has previously been opened in accordance with the invention and remained open and that the trailing edge 5*b* of the printing plate 5 has previously been released. The trailing edge has been moved out of the second clamping device or has flipped out of the latter and now rests upon the first guide 2*a*, along which it is moved into the plate changing device 2 by the rotary movement 7. For this purpose, the first guide 2*a* has previously been moved into a printing plate changing position.

In accordance with the invention, the first clamping device 9 has likewise previously been opened and remained open and the leading edge 5*a* of the printing plate 5 has previously been released and remained released. Yet during the first rotation, the leading edge remains in the second clamping device.

Thus in accordance with the invention, both clamping devices 9 and 10 have been opened and remain opened during the first rotation.

Figure 3:
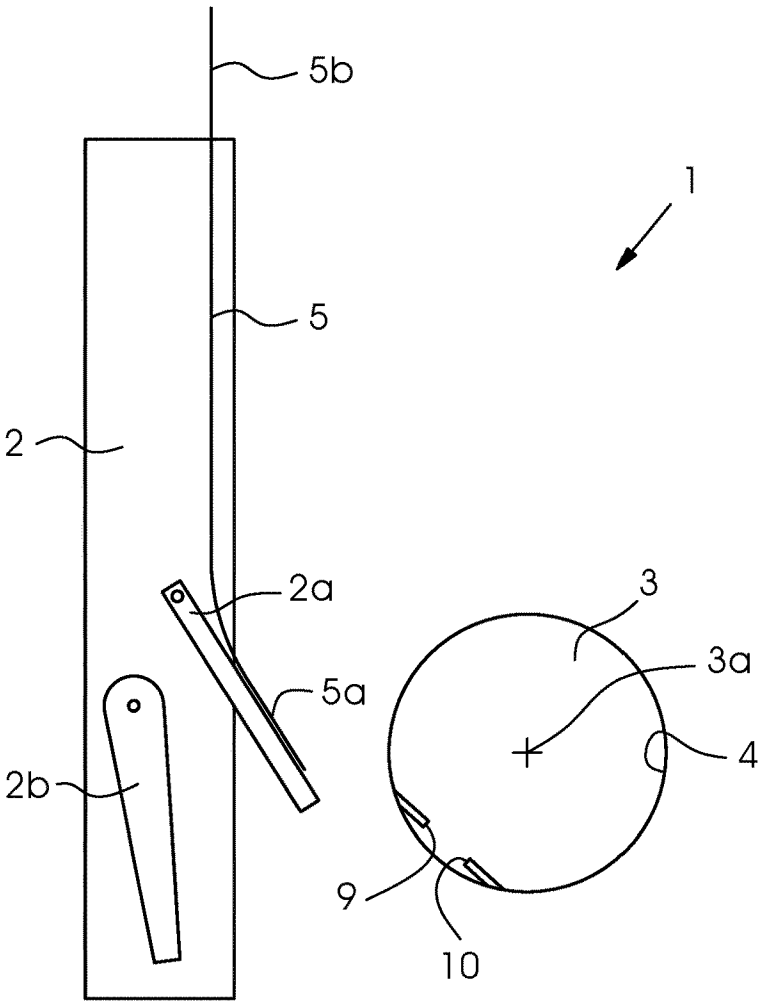

FIG. 3 illustrates the same cylinder 3 in a second stand-by position different from the first stand-by position. FIG. 3 indicates that now the first clamping device 9 is likewise open. As a consequence, the leading edge 5*a* of the printing plate has been released and moved out of the first clamping device. The printing plate 5, which has been removed from the cylinder 7 in its entirety and has been dismounted from the cylinder surface 4, is now located in the plate changing device 2. The printing plate may be pushed into the plate changing device by the cylinder.

In the stand-by position of the cylinder 3 shown in FIG. 3, both clamping devices 9 and 10 remain open.

Figure 4:
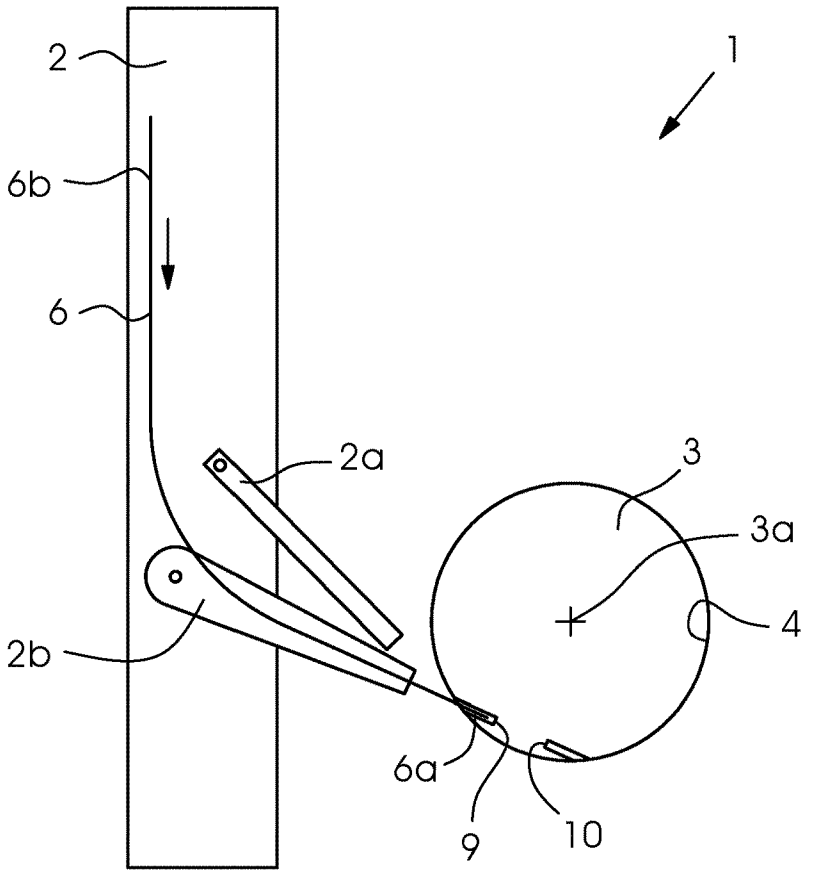

FIG. 4 illustrates the same cylinder 3 in a third stand-by position different from the second stand-by position. The third stand-by position is the result of an intermediate rotation out of the second stand-by position shown in FIG. 3. For this purpose, the cylinder 3 has been rotated into a second direction 8 (cf. FIG. 5).

In FIG. 4, the second guide 2*b* of the plate changing device 2 has been pivoted into a position for feeding a second printing plate 6. A leading edge 6*a* of the second printing plate 6 is introduced into the first clamping device 9. Then the first clamping device 9 closes. The second clamping device 10 remains open.

Figure 5:
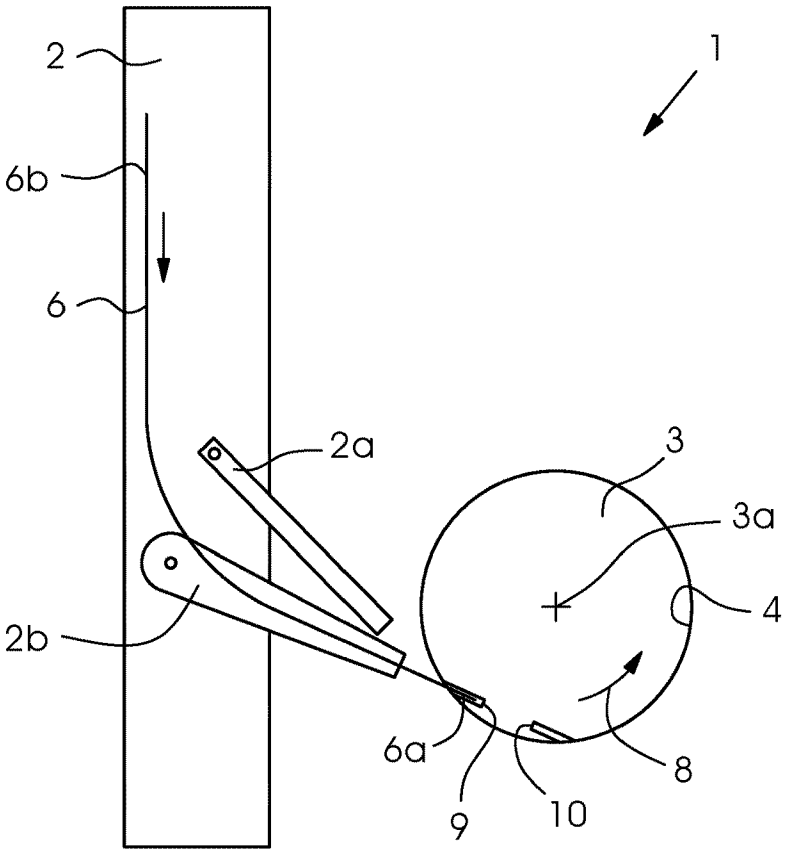

FIG. 5 illustrates the same cylinder 3 during a rotation 8 (second rotation) in a direction opposite that of rotation 7 (shown, for instance, in FIG. 2). Due to this rotation, the second printing plate 6 is pulled out of the plate changing device 2 and applied/mounted to the circumferential surface 4 of the cylinder 3.

Figure 6:
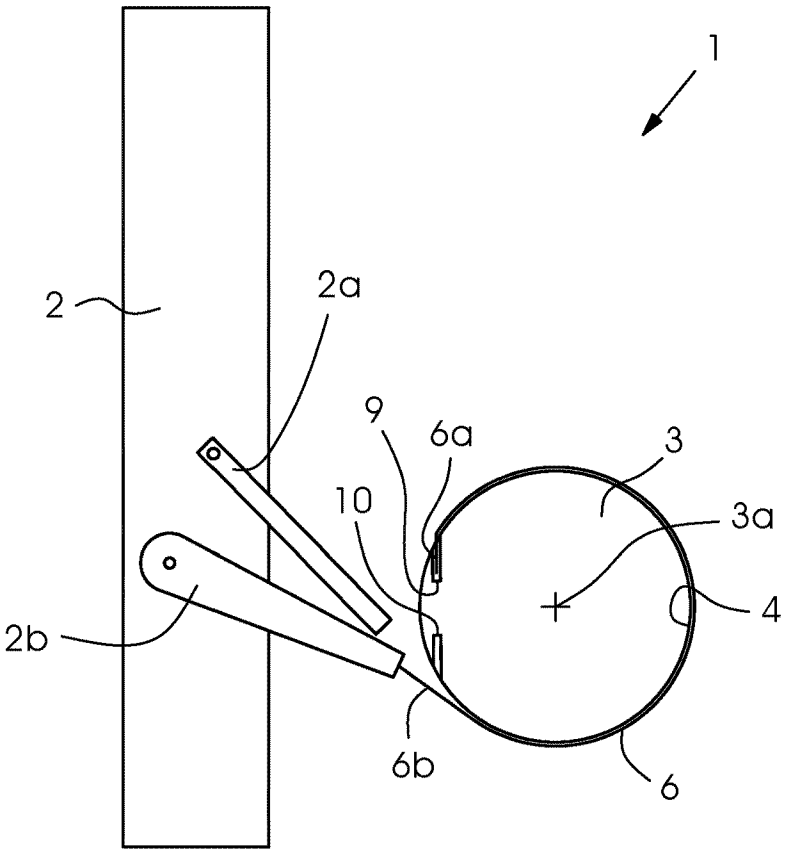

FIG. 6 illustrates the same cylinder 3 in a fourth stand-by position different from the third stand-by position. In this position, a trailing edge 6*b* of the second printing plate 6 is pushed into the second clamping device 10. This process requires a pressure element, which is not illustrated in FIG. 6. The pressure element may be a pressure roller or a pressure bar.

Figure 7:
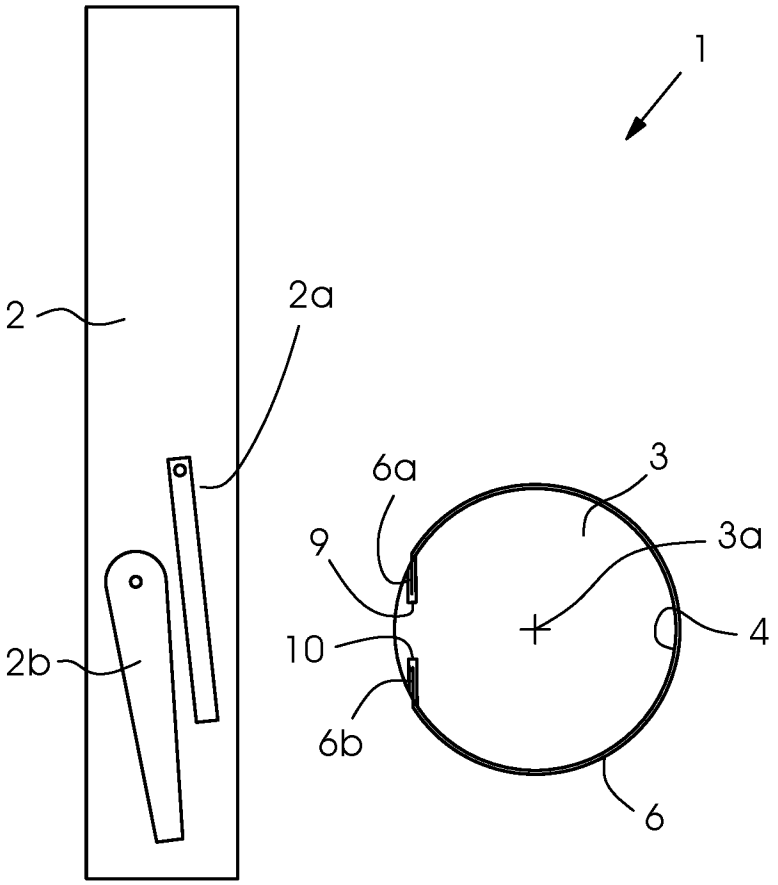

FIG. 7 illustrates the same cylinder 3 in the fourth stand-by position shown in FIG. 6, but with the trailing edge 6*b* inserted into and clamped in the clamping device 10. Thus in the fourth stand-by position, the first and second clamping devices 9, 10 are closed. The first and second guides 2*a* and 2*b* have been pivoted back into the plate changing device 2.

The cylinder 3 with the newly-mounted second printing plate 6 is now ready for a following print job.

Figure 8:
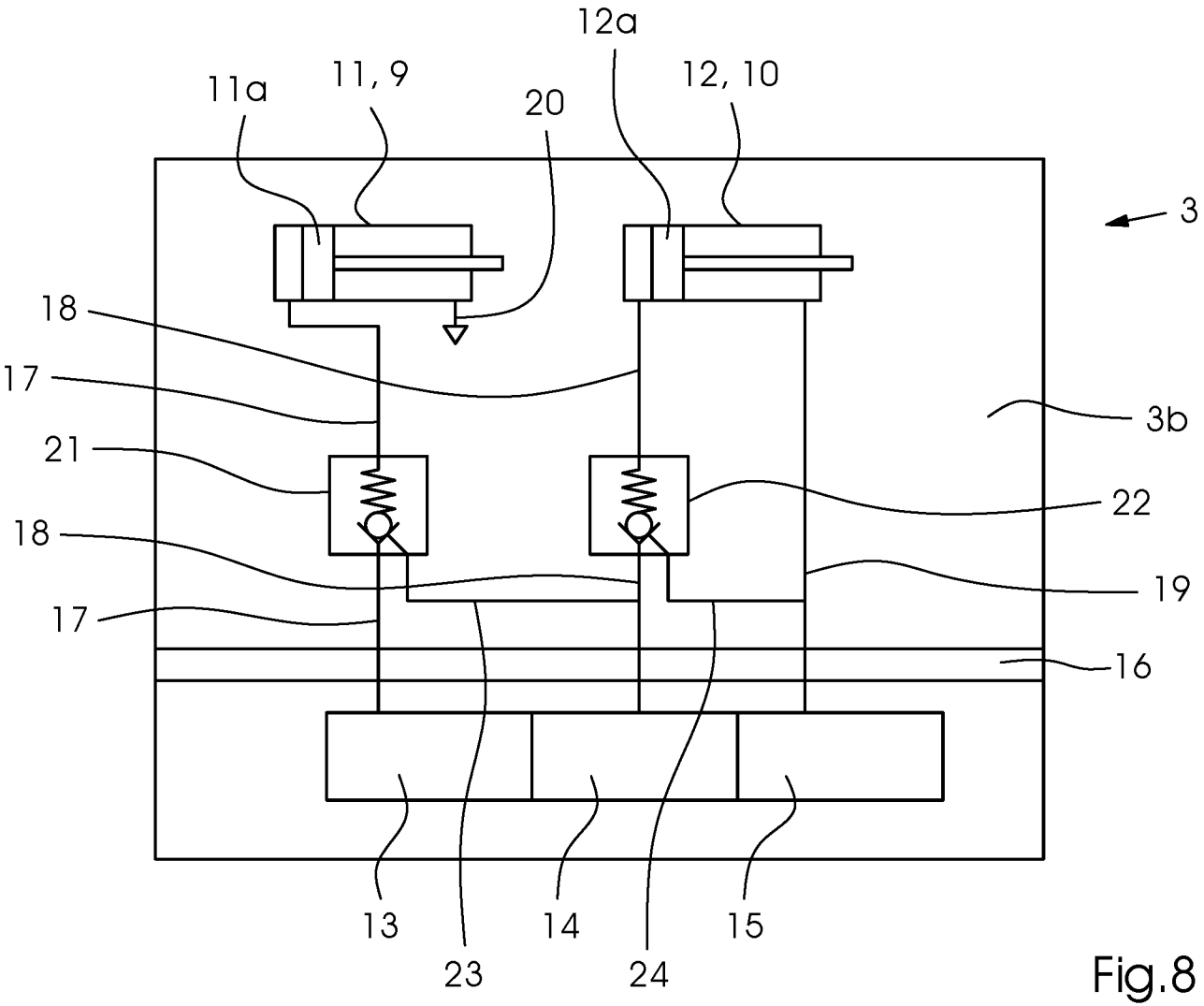
FIG. 8 is a block diagram of a preferred embodiment of the device according to the invention.

FIG. 8 is a schematic representation of a preferred embodiment of the pneumatic assembly of a device of the invention.

FIG. 8 schematically shows the cylinder 3 and an interior 3*b* of the cylinder. A first pneumatic cylinder 11 and a second pneumatic cylinder 12 are disposed in the interior of the cylinder. The first pneumatic cylinder 11 is assigned to the first clamping device 9 and the second pneumatic cylinder 12 is assigned to the second clamping device 10.

A first, second, and third compressed air source 13, 14, and 15 are provided outside the cylinder 3. A rotary joint 16 for pneumatic lines is disposed between the compressed air sources and the cylinder.

A first pneumatic line 17 runs from the first compressed-air source 13 to the first pneumatic cylinder 11, allowing the latter to be operated and its cylinder piston 11*a* to be extended. A second pneumatic line 18 runs from the second compressed-air source 14 to the second pneumatic cylinder 12, allowing the latter to be operated and the cylinder piston 12*a* thereof to be extended. A third pneumatic line 19 runs from the third compressed-air source 15 to the second pneumatic cylinder 12, allowing the cylinder piston 12*a* thereof to be retracted. A fourth pneumatic line 20 runs to the first pneumatic cylinder 11, allowing the cylinder piston 11*a* thereof to be retracted.

FIG. 8 further illustrates a first releasable check valve 21 and a second releasable check valve 22. The first check valve 21 is located in the first pneumatic line 17. The second check valve 22 is located in the second pneumatic line 18. A first control line 23 connects the first check valve 21 and the second pneumatic line 18. A second control line 24 connects the second check valve 22 and the third pneumatic line 19. The first check valve 21 may be released by means of the first control line 23 and the second check valve 22 may be released by means of the second control line 24.

The table illustrated below indicates a preferred logic circuitry for the method of the invention and the device of the invention:

"0" in the table means that the check valve 21 or 22 in question is closed and "1" means that the corresponding check valve 21 or 22 is released.

When the printing plate 5 is to be released, the air controlling valve 21 ("open clamping bar") is operated via control line 23 and the air controlling valve 22 ("open tensioning bar") is operated via control line 24, i.e. the valves are released. The clamping bar 9 and the tensioning bar 10 are open.

Then valve 22 is switched off/reclosed. The tensioning bar 10 remains open because of the air that is trapped in pneumatic line 18. Then valve 21 is switched off/reclosed to "open the clamping bar". The tensioning bar likewise remains open because air is trapped in pneumatic line 17.

Now the printing plate 5 is pushed out and finally pulled out of the first clamping device 9 (clamping the leading edge).

Subsequently, the leading edge 6*a* of the new printing plate 6 is introduced into the first clamping device 9. Valve 22 is actuated ("open the tensioning bar") by means of pneumatic line 18 to release valve 21 and close clamping bar 9. Then the "open the tensioning bar" mode is switched off.

Subsequently, the new printing plate 6 is pulled in and the plate cylinder is moved to a "push in the trailing edge" position. The trailing edge 6*b* is inserted into the tensioning bar 10 and valve 22 is actuated to de-aerate. The tensioning bar 10 closes and tensions the printing plate. Finally, valve 22 is switched off/reclosed to switch off the "close tensioning bar" mode.

The following is a summary list of reference numerals and the corresponding structure used in the above description of the invention:

1 printing press
2 plate changing device
2*a* first (pivoting) guide
2*b* second (pivoting) guide
3 cylinder
3*a* axis
3*b* interior of the cylinder
4 circumferential surface
5 first printing plate
5*a* leading edge of the first printing plate
5*b* trailing edge of the first printing plate
6 second printing plate
6*a* leading edge of the second printing plate
6*b* trailing edge of the second printing plate
7 first direction

| | Valves | | | clamping device mode | |
|---|---|---|---|---|---|
| | open | open | close | | |
| Logic Circuitry: | clamping bar | tensioning bar | tensioning bar | clamping bar | tensioning bar |
| valve reference numeral | 21 | 22 | 22 | | |
| clamping device reference numeral | | | | 9 | 10 |
| basic condition | 0 | 0 | 0 | closed | closed |
| release the trailing edge | 1 | 1 | 0 | open | open |
| | 1 | 0 | 0 | open | open |
| | 0 | 0 | 0 | open | open |
| release the leading edge | 0 (1) | 0 | 0 | open | open |
| clamp the leading edge | 0 | 1 | 0 | closed | open |
| | 0 | 0 | 0 | closed | open |
| clamp trailing edge | 0 | 0 | 1 | closed | closed |
| basic condition | 0 | 0 | 0 | closed | closed |

8 second direction
9 first clamping device (clamping bar for the leading edge)
10 second clamping device (tensioning bar for the trailing edge)
11 first pneumatic cylinder
11*a* first cylinder piston
12 second pneumatic cylinder
12*a* second cylinder piston
13 first compressed-air source
14 second compressed-air source
15 third compressed-air source
16 rotary joint
17 first pneumatic line
18 second pneumatic line
19 third pneumatic line
20 fourth pneumatic line
21 first check valve (releasable)
22 second check valve (releasable)
23 first control line
24 second control line

The invention claimed is:

1. A method for changing printing plates on cylinders, which comprises the steps of:

opening a first clamping device and releasing a leading edge of a first printing plate;

opening a second clamping device and releasing a trailing edge of the first printing plate, wherein the first clamping device and the second clamping device are both opened before a first rotation process of a cylinder is performed;

rotating the cylinder to perform the first rotation process in a first direction to dismount the first printing plate from a circumferential surface of the cylinder, the first clamping device and the second clamping device both remaining open during the first rotation process; and rotating the cylinder to perform a second rotation process in a second direction, being opposite to the first direction, to mount a second printing plate replacing the first printing plate to the circumferential surface of the cylinder, the first clamping device and the second clamping device both remaining open during a period between the first rotation process and the second rotation process;

rotating the cylinder to perform an intermediate rotation in the second direction during which the first clamping device and the second clamping device both remain open, the intermediate rotation occurring between the first and second rotation processes.

2. The method according to claim 1, which further comprises closing the first clamping device before performing the second rotation process.

3. The method according to claim 2, which further comprises closing the second clamping device after the second rotation process is performed.

* * * * *